United States Patent [19]

Voegeli

[11] 4,371,072

[45] Feb. 1, 1983

[54] COIN-OPERATED LATCH MECHANISM

[76] Inventor: Ronald Voegeli, 918 Gibbs Rd., Venice, Fla. 33595

[21] Appl. No.: 218,775

[22] Filed: Dec. 22, 1980

[51] Int. Cl.[3] ..... G07F 5/06

[52] U.S. Cl. ..... 194/54; 194/1 K

[58] Field of Search ..... 194/54, 59, 65, 71, 194/DIG. 2, 1 K, 1 G

[56] References Cited

U.S. PATENT DOCUMENTS

| | | | |
|---|---|---|---|
| 3,503,482 | 5/1968 | Davis | 194/54 |
| 3,884,330 | 5/1975 | Chalabian | 194/59 |
| 4,093,058 | 6/1978 | Terry | 194/71 |

*Primary Examiner*—Stanley H. Tollberg

*Attorney, Agent, or Firm*—Burns, Doane, Swecker & Mathis

[57] ABSTRACT

A coin-operated latch mechanism includes a unitary frame member constructed of a single piece of material having a shape generally similar to that of an I-beam, to thereby reduce the number of parts required to construct the mechanism and simplify manufacturing operations. The unitary frame construction also provides significant advantages with respect to durability and resistance to corrosion. A pair of pivotal channel members that engage the frame to form coin chutes also engage one another by means of meshed teeth, so that pivotal motion imparted to one channel member will result in equal and opposite motion of the other channel member to thereby pivot the channel members away from the frame and open the coin chutes to enable trapped coins to be released.

18 Claims, 6 Drawing Figures

COIN-OPERATED LATCH MECHANISM

BACKGROUND OF THE INVENTION

The present invention relates to coin-operated latch mechanisms particularly adapted for use in newspaper vending machines and the like, and more specifically to an improved form of coin-operated latch mechanism of the type disclosed in U.S. Pat. Nos. 3,760,923 and 3,870,136, for example.

Coin-operated latch mechanisms of the type disclosed in these patents have been utilized with a great deal of success in the past. The present invention is directed to improvements in the construction of these types of latch mechanisms for increasing the durability and operation of these devices. For example, coin-operated latch mechanisms implementing the inventions of these two patents have previously employed a two-piece frame member, generally made of steel, that is held together by means of spot welds. The need to spot weld the frame member during construction of the mechanism contributes to the overall cost of the finished product. In addition, the joining together of two steel pieces by means of the spot welds provides spaces between the elements in which moisture can collect, consequently leading to rust and corrosion of the frame member. Furthermore, the handling of two separate elements and the joining of them to make a single frame member limits the tolerances which can be obtained on the dimensions of the frame.

It is therefore a general object of the present invention to provide a novel coin receiving mechanism for use in a coin-operated latch unit that is substantially improved over similar types of prior art devices with respect to complexity and ease of manufacture.

It is another object of the present invention to provide a novel coin receiving mechanism having fewer elements and increased durability over prior art mechanisms.

Another feature of the prior art coin mechanisms that is desired to be improved upon relates to the wear of mechanical parts. A coin-operated latch mechanism of the type disclosed in the previously cited patents includes a latch member that is spring biased into engagement with a surface on the coin receiving mechanism. In the prior construction of these latch mechanisms, that engagement surface was formed by the frame itself. In operation, the spring biased latch member slides along the engagement surface during each opening and closing of a door that is controlled by the latch mechanism. It will be appreciated that after a substantial amount of use of the latch mechanism, the wear on the engagement surface of the frame could necessitate the replacement of the frame. Since the frame is an integral element of the coin receiving mechanism, replacement of the frame usually is accomplished by replacement of the entire mechanism.

It is therefore another object of the present invention to provide a novel coin receiving mechanism in which normal maintenance of worn parts can be accomplished without replacement of the entire mechanism.

Another feature of the coin-operated latch mechanism to which the present invention is directed relates to the operation of the coin return assembly. In the prior mechanisms, the coin return assembly included a cam member that was pivoted into abutting engagement with the channel members forming the coin slots of the mechanism, to pivot the channel members away from the frame and thereby open the coin slot so that any bent or trapped coins could be released. Due to the particular design of the cam and channel members, the pivoting of the cam member and its engagement with the channel members imparted motion to the channel members in two directions. Specificaly, in addition to moving away from the frame as desired, the channel members also had a component of motion in a direction generally parallel to the frame, due to the direction of movement of the cam member, (as can be seen from the illustrations of FIGS. 7 and 8 of U.S. Pat. No. 3,870,136). Consequently, the coin receiving mechanism had to be constructed to provide sufficient space for this bidirectional movement of the channel members. Furthermore, the particular design of the cam member requires a fair amount of force to be applied to move the channel members, since the direction of force applied by the consumer is not in the same direction as the force applied to the channel members by the cam member.

It is therefore a further object of the present invention to provide a novel coin receiving mechanism in which the elements of the mechanism forming the coin receiving slots are required to move in one direction only in order to open the slots to release bent or trapped coins.

It is yet another object of the present invention to provide a novel coin receiving mechanism requiring a decreased amount of force necessary to actuate the coin return assembly and subsequently return it to a normal position.

BRIEF DESCRIPTION OF THE DRAWINGS

The manner in which these and other objects and advantages are achieved in accordance with the present invention will be appreciated from the following detailed description of a preferred embodiment of the invention when taken in conjunction with the accompanying drawings, in which.

DETAILED DESCRIPTION OF THE PREFERRED EMBODIMENT

The present invention is described hereinafter with particular reference to its use in a coin-operated newspaper vending machine. However, it will be appreciated by those of ordinary skill in the art that the invention has general application in other fields in which a latch member is to be released only upon the depositing of coins equalling or exceeding a predetermined monetary value.

Figure 1:
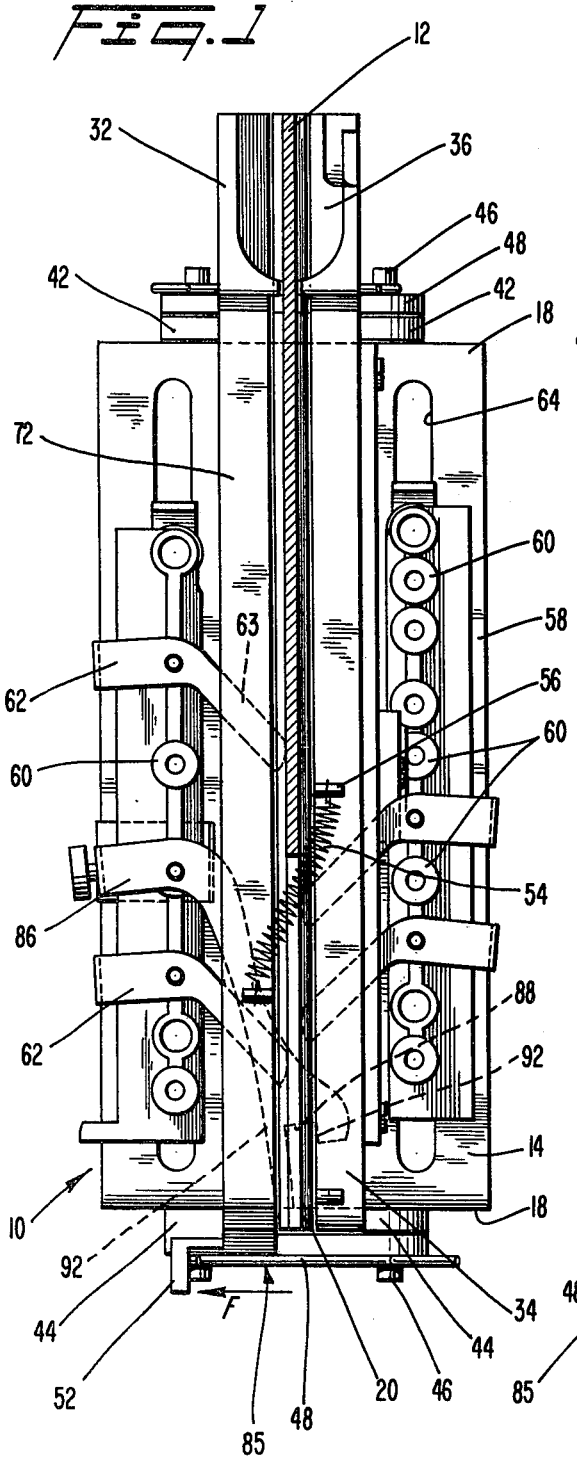
FIG. 1 is a front sectional view of the coin receiving mechanism taken along the sectional line I—I of FIG. 3.
Figure 2:
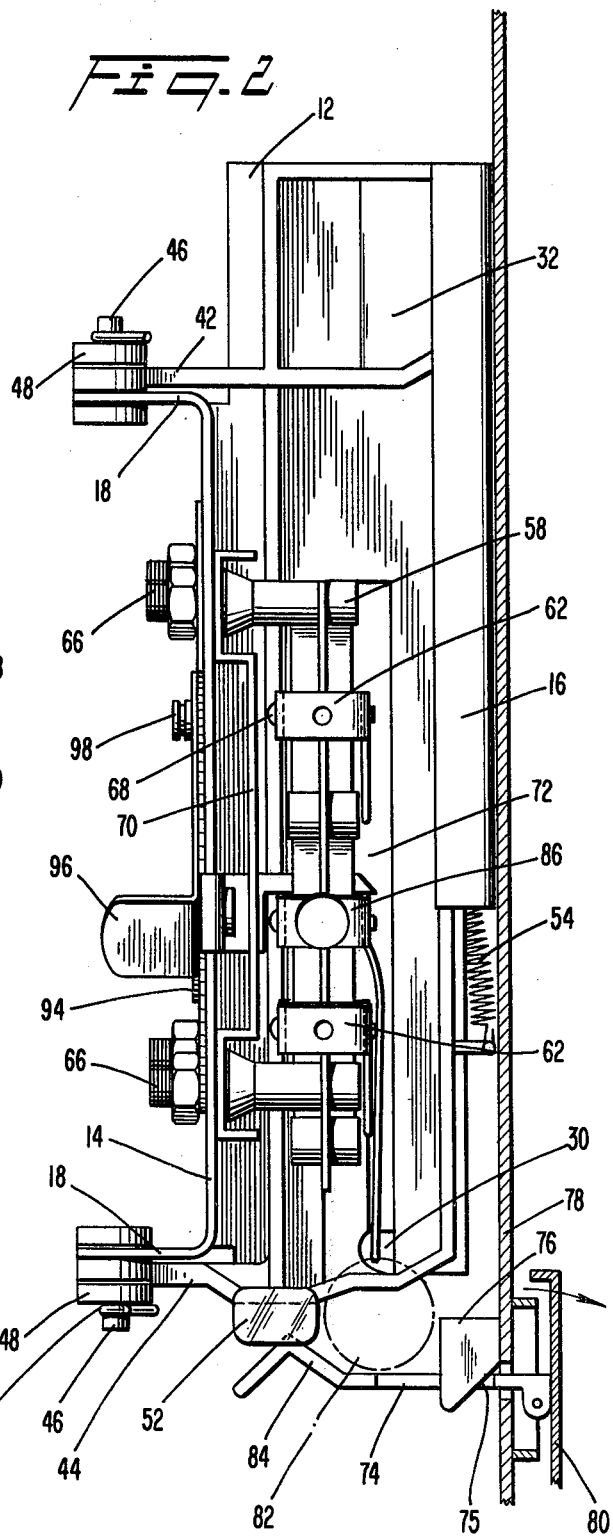
FIG. 2 is a side view of the coin-operated latch mechanism.
Figure 3:
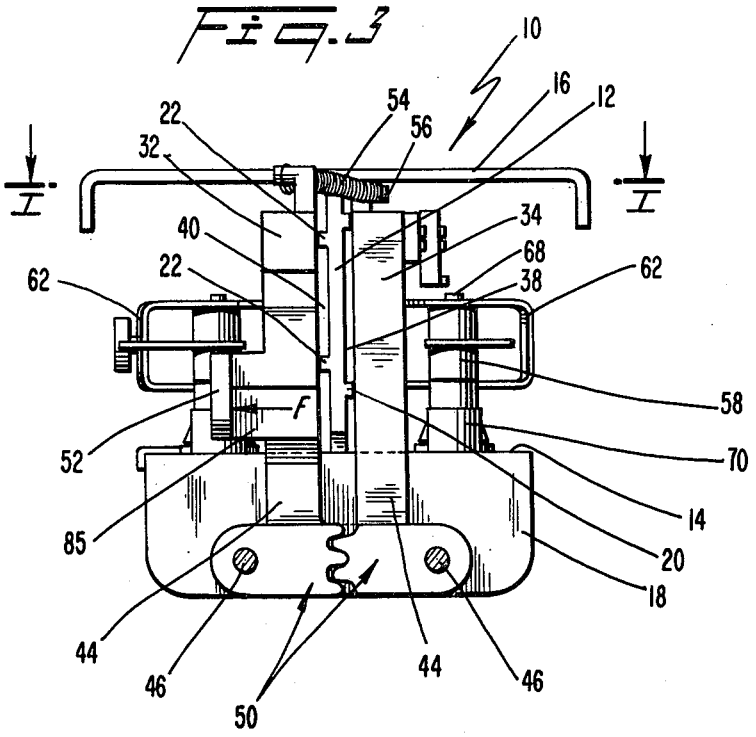
FIG. 3 is a bottom view of the coin receiving mechanism illustrating the channel members in a normally closed position.

Referring generally to FIGS. 1, 2 and 3, the coin receiving mechanism includes a unitary frame member 10. As best seen in FIG. 3, the frame member basically has the cross-sectional configuration of an I-beam, with a central wall 12 and a perpendicular mounting plate 14 or 16 integrally attached to the central wall on the opposite ends thereof. The rear mounting plate 14 has a pair of mounting flanges 18 respectively disposed at the top and bottom thereof on the side opposite the central wall 12 (FIG. 2). The central wall includes a pair of spaced, parallel guide ribs 20, 22 on each side thereof. The distance between each guide rib in a pair is determined in accordance with the size of a coin intended to be deposited in the coin receiving mechanism, to thereby define a coin chute between each pair of ribs. For example, with reference to coins of U.S. denomination, the guide ribs 20 on one side of the wall 12 are spaced an amount sufficient to enable a quarter or a nickel to lie flat against the wall between them. Likewise, the distance between the two guide ribs 22 on the other side of the wall is sufficient to accommodate a dime.

Figure 4:
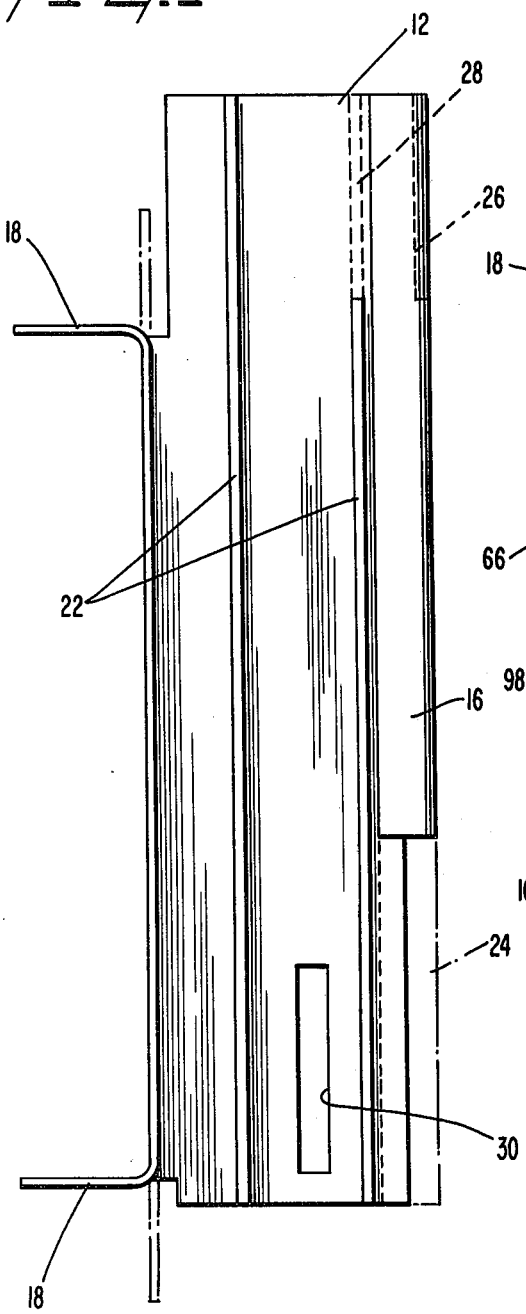
FIG. 4 is a side view of the unitary frame member of the coin receiving mechanism.

The unitary frame member 10 is constructed from a single piece of material. In one embodiment of the invention, the material is aluminum, which is chosen because of its light weight and corrosion resistant properties. In this embodiment of the invention, the aluminum is extruded in long strips having a shape substantially conforming to the design of the frame. The strips can be cut into frames of desired length, and then appropriately formed to achieve the final intended design. Specifically, referring to FIG. 4, after the extruded piece of aluminum or other metal has been cut to the proper length, a cut can be made between the central wall 12 and the rear mounting plate 14 to enable the end portions of the mounting plate to be bent from their initial positions, indicated by the dotted lines, to form the mounting flanges 18. The bottom portion 24 of the front mounting plate 16 can be cut away to provide appropriate room for other elements of the coin receiving mechanism. In addition, slots 26 can be provided at the top of the front mounting plate 16, and the top portion 28 of the forward one of the guide rails 22 can be cut or ground away, to provide an appropriate opening for a coin to be inserted in the coin chute defined between the ribs 22. In addition, a cutout 30 can be stamped or otherwise provided in the coin chute, if necessary to accommodate other elements of the coin receiving mechanism.

It will be appreciated that other types of materials can be used to construct the frame member. For example, a suitable plastic can be used. In such a case, the plastic can be injection molded, rather than forming it according to the embodiment illustrated in FIG. 4.

In addition to the frame member 10, the coin receiving mechanism includes a pair of channel members 32, 34 respectively disposed on either side of the central wall 12. As best illustrated in FIG. 3, the surface of each channel member facing the central wall 12 is substantially flat and abuts against the guide ribs 20 or 22 on the central wall. The top of each channel member has a suitable opening 36 (FIG. 1) for receiving a deposited coin. The channel members, in combination with the central wall 12 of the frame member 10 and the guide ribs 20 or 22 on the central wall, form a coin chute 38, 40 through which deposited coins pass. Each of the channel members 32, 34 has a pair of arms 42, 44 respectively disposed near the top and bottom thereof and projecting from one side of the arm. The arms are pivotally attached to the mounting flanges 18 of the frame member 10 by means of suitable pins 46 and caps 48, or the like.

Figure 5:
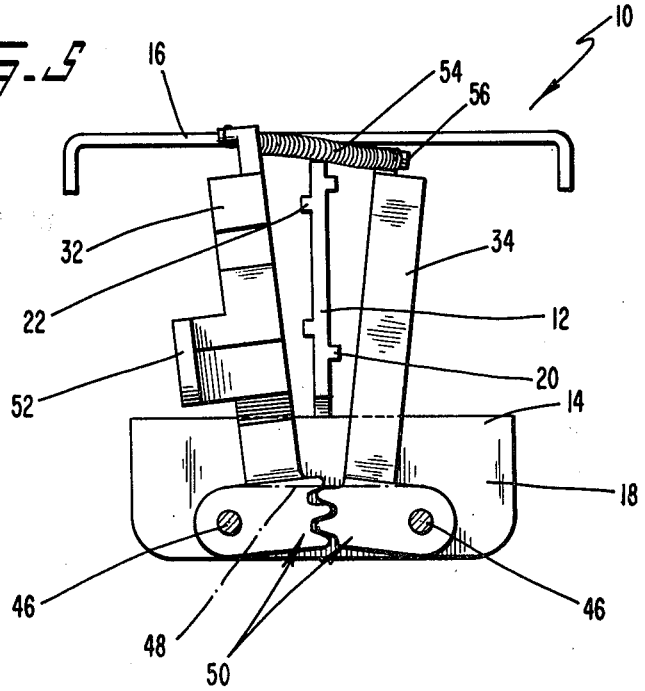
FIG. 5 is a bottom view of the coin receiving mechanism illustrating the channel members in the open, coin return position.

FIG. 3 illustrates the bottom arms 44 of the channel members 32 and 34 with the cap removed. As can be seen, each of the arms includes a set of teeth 50 adapted to mesh with those of the adjacent arm. In addition, one of the channel members 34 includes a projection 52 disposed to the side and depending downwardly from the channel member. When a force in the direction of the arrow F (FIGS. 1 and 3) is applied to the projection 52, the channel member 34 will be pivoted in a counterclockwise direction, as viewed in FIG. 3. Furthermore, due to the meshed teeth of the two channel members, the other channel member 32 will be pivoted by an equal amount in the opposite direction, as illustrated in FIG. 5. Thus, for example, by providing such a force through a coin return mechanism, such as that disclosed in U.S. Pat. No. 3,870,136, the two channel members 32 and 34 will be pivoted away from the central wall 12, to allow any coins, such as bent coins, which may be trapped within the coin chutes 38, 40 to be released and fall into the coin return assembly.

In order to maintain the channel members normally engaged with the ribs 20, 22 on the central wall 12, a tension spring 54 is connected across the two channel members 32 and 34 on the sides opposite from the arms 42 and 44, by means of suitable projections 56 or the like. As generally illustrated in FIGS. 1 and 2, the spring 54 is preferably disposed on a diagonal with respect to the channel members and the frame member, i.e. the projection 56 on one channel member 32 is lower than that on the other channel member 34. With such an arrangement, the spring 54 exerts an upward force on the channel member 32 to hold it up against the frame member 10 during a coin return operation, as well as normally bias both channel members into engagement with the ribs 20, 22.

The movement of the channel members 32, 34 during a coin return operation in the mechanism of the present invention is to be contrasted with that of prior art mechanisms, such as that illustrated in FIGS. 7 and 8 of U.S. Pat. No. 3,870,136. In the mechanism of that patent, the channel members are biased into engagement with the web portion of the frame by means of torsion springs disposed on the pivot axes of the channel members. Due to the remote location of the pivot axes from the channel members, a force necessary to overcome the force of the torsion springs and move the channel members must be applied in a direction generally parallel to the central web, and hence perpendicular to the desired direction of motion of the channel members away from the web, in order to release trapped coins. In contrast, due to the arrangement of the channel members in accordance with the present invention, the force applied to the channel members is substantially parallel with the desired motion of one of the channel members, and is directly applied to the other channel by means of the meshed teeth. Furthermore, since the present invention requires only a single tension spring to maintain the channel members in their normally closed position, it is only necessary to overcome the force of this single spring, rather than the force of two or four torsion springs as in the prior art devices. Therefore, the present invention substantially reduces the number of parts required to make up this assembly and furthermore requires a lesser amount of force to achieve the coin release operation.

Referring again to FIGS. 1-3, a pawl support mechanism is attached to the rear mounting plate 14 on each side of the central wall 12 of the frame member. Each pawl support mechanism includes a bar 58 having a plurality of apertures 60 for pivotably supporting one or more pawls 62 at various locations along the length of the coin chutes 20 and 22. In order to provide for adjustment of the locations of the pawls along the coin chutes, the rear mounting plate 14 is provided with a slot 64 on each side of the central wall 12 for accommodating suitable connecting devices, such as bolts 66, on the support bars 58 and enabling the support bars to longitudinally slide along the frame. Each pawl is mounted on a support bar 58 by means of a suitable pin 68 that passes through the legs of a U-shaped portion of the pawl and an appropriate aperture in the support bar 58.

To eliminate the need to fasten the pins 68 by means of riveting, threading a nut, or the like, and thereby facilitate the removal and relocation of pawls as well as simplify the manufacturing operation, the pawl support mechanism also includes a strap 70 which underlies the heads of the pins 68. As can be seen in FIG. 2, the strap 70 includes a raised central portion that lies adjacent the heads of the pins 68. In addition, the end portions of the strap can be raised to lie adjacent the heads of any pins located in any apertures at the ends of the bar 58. Thus, once the pawls 62 are mounted on the bar 58 by inserting their associated pins 68 in the appropriate apertures 60 in the strip, the strap 70 is placed in the position illustrated in FIG. 2 and the entire assembly is bolted to the rear mounting plate 14 by means of the fasteners 66. The pins 68 are held in place by the strap 70, with limited freedom of movement, and therefore need not be riveted, threaded, or the like, thereby simplifying the manufacturing operation.

Each of the channel members 32, 34 includes a longitudinal slot 72 for accommodating fingers 63 of the pawls 62 and enabling the pawls to be disposed within the coin chutes 38, 40. The pawls are appropriately designed, or weighted, so that an end thereof will lie within the coin chute in a normal position. In operation, when a coin is deposited in the coin chute, it will deflect a pawl as it passes it, and thereafter the pawl will return to its normal position. The latch mechanism includes a pivotally mounted latch member 74 that is normally spring biased to the position illustrated in FIG. 2. An aperture 75 in the latch member normally accommodates a latch hook 76 attached to the housing 78 of the newspaper vending machine, or the like. The hook 76 engages the edge of the aperture and normally prevents a door 80 of the newspaper vending machine from being opened.

When a coin, such as a dime 82, is deposited in the newspaper vending machine, it falls through one of the coin chutes 38, 40 and comes to rest on its edge on the latch member 74. As additional dimes are deposited, for example, they are stacked edgewise upon one another in the coin chute 40. When the proper combination of coins have been deposited, the top edge of the uppermost coin in the stack of coins will lie just underneath one of the appropriately positioned pawls 62. The pawl will prevent the stack of coins from moving upwardly in the coin slot, and therefore as the door 80 of the newspaper vending machine is pulled to the right, as illustrated in FIG. 2, the lowermost coin 82 in the rigid stack of coins will engage a cam surface 84 on the latch member. The coin will cause the latch member 74 to pivot in a counterclockwise direction as viewed in FIG. 2, thereby disengaging the latch member from the latch hook 76, and enabling the door to be opened. Once the latch member 74 has passed from beneath the coins, they will fall out of the coin chute into a coin receiving tray (not shown) for later collection.

Preferably, a plurality of pawls 62 are mounted on the pawl support assembly in order to enable the latch mechanism to be operated with different combinations of coins equaling or exceeding the same price. For example, for a fifteen cent item, one pawl may be disposed in the quarter-nickel coin chute 38 to enable the latch to be opened with a deposit of three nickels, and another pawl can be disposed in the dime chute 40 so that two dimes will actuate the latch. Furthermore, in order to actuate the latch with a combination of coins deposited in more than one slot, e.g. one dime and one nickel, a specially designed "carry-over" pawl 86 can be provided on the latch mechanism. This pawl is designed so that a nickel or a dime deposited by itself will be disposed within a slot 88 in the pawl that does not prevent the deposited coin from riding upwardly within the coin chute when engaged by the cam surface 84 of the latch member. However, when both a dime and a nickel are deposited, the dime lying within the coin chute 40 will engage one leg 90 of the pawl and cause the pawl 86 to be rotated a slight amount in the clockwise direction as viewed in FIG. 1. This rotation of the pawl is sufficient to cause a second leg 92 thereof to just overlie the deposited nickel and enable the nickel to act as the stationary cam which forces the latch member 74 down when the door is pulled open.

In operation, the spring bias on the latch member 74 causes its cam surface 84 to engage an underside surface of the coin-receiving mechanism, and hence causes wear due to the sliding motion imparted to the latch member during each opening and closing of the door. In the prior art mechanisms, the cam surface 84 engaged a surface of the frame member (as illustrated in U.S. Pat. No. 3,760,923). If the sliding engagement resulted in substantial wear on the surface of the frame member, the entire coin-receiving mechanism had to be replaced, leading to a considerable expense. However, in accordance with the present invention, the surface 85 engaged by the cam 84 is provided by the underside of one of the channel members 32, adjacent the projection 52. Thus, when wear occassioned by the sliding engagement requires replacement of an element, only the channel member 32 need be replaced, rather than the entire mechanism. This operation can be carried out quite easily through removal of the caps 48 and pins 46. In the preferred embodiment of the invention, the channel members 32 and 34 are made of plastic, and therefore the costs associated with replacement of the worn part are minimal in comparison with prior art mechanisms.

Figure 6:
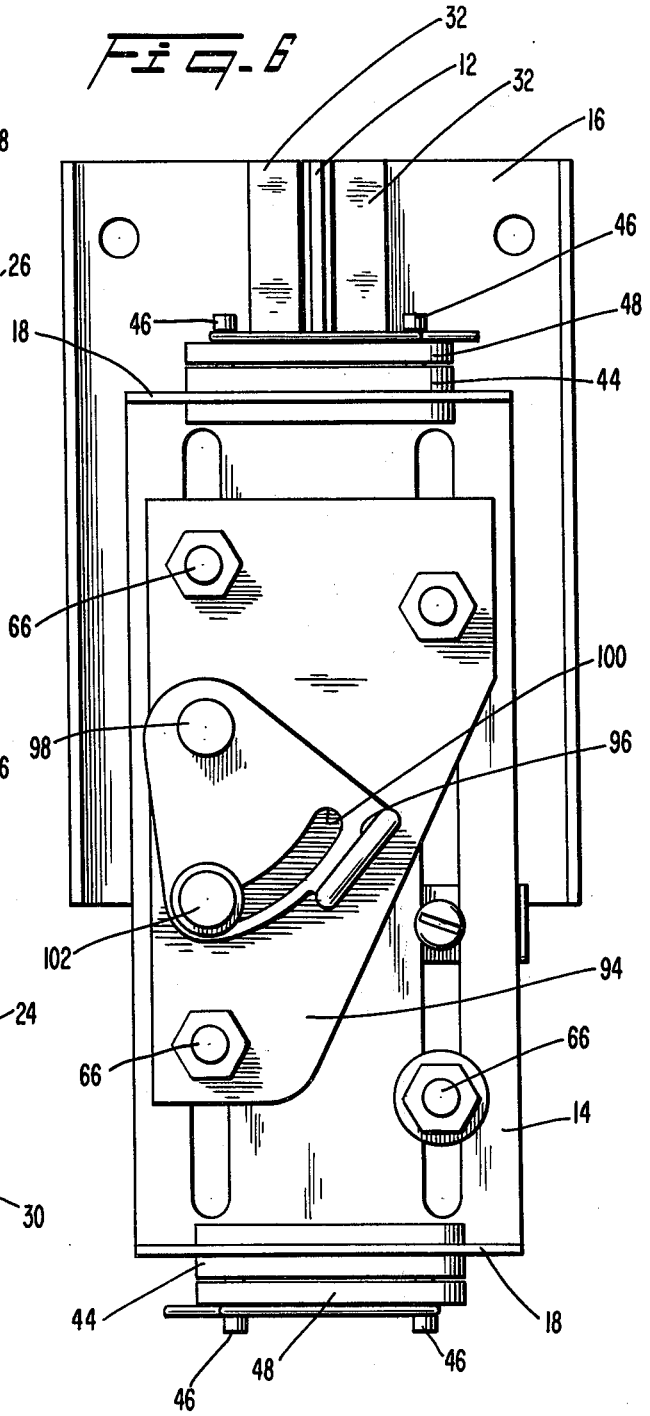
FIG. 6 is a rear view of the coin receiving mechanism.

In order to accommodate price changes, such as the difference in price between daily and Sunday papers, a cam mechanism is provided for shifting the pawl support mechanism between first and second positions, to thereby reposition the pawls in accordance with the desired prices. Referring to FIGS. 2 and 6, a backing plate 94 lies on the side of the rear mounting plate 14 opposite the side on which the pawl support mechanism is disposed. A camming member 96 is pivotally mounted with respect to the backing plate 94 and the frame 10 by means of a pin 98 fixedly attached to the rear mounting plate 14 of the frame. An arcuate cam slot 100, eccentrically located with respect to the pin 98, accomodates a second pin 102 fixedly attached to the backing plate 94. Due to the eccentric disposition of the arcuate cam slot 100 with respect to the pivot pin 98, a pivoting of the camming member 96 about the pivot pin 98 will cause the second pin 102, and hence the backing plate 94, to be shifted longitudinally along the mounting plate 14. The pawl support mechanism is securely attached to the backing plate 94, and therefore a shifting of the backing plate 94 by pivotal motion of the camming member 96 will also cause the pawls mounted on the pawl support mechanism to be relocated, thereby enabling the latch mechanism to be operated with a different set of coin combinations. For example, the shifting of the position of the pawl support mechanism can be by an amount sufficient to enable the carryover pawl 86 to operate with a coin combination of a dime and quarter, rather than a dime and a nickel, to enable a 35¢ Sunday paper to be purchased.

Further details of the operation of the latch mechanisms of this type can be obtained with reference to the previously cited U.S. patents.

From the foregoing, it will be appreciated that the present invention provides a novel coin-operated latch mechanism that is noticeably simplified over the prior art mechanisms, with respect to both number of elements and manufacturing steps. The provision of a unitary frame member constructed from a single piece of material substantially simplifies the construction of the latch mechanism. In addition, since only a single piece of material is being handled during construction, much greater tolerances can be obtained than in the case where two separate pieces have to be accurately matched and joined to one another. Furthermore, the unitary frame member does not provide any housing for moisture to accumulate and rust or corrosion to result.

Other differences beteen the present invention and prior art coin operated latch mechanisms offer still further reduction in the number of required parts, such as for example with respect to the elements forming the pivotable channel members that provide for coin release operations. In addition, the novel arrangement of the channel members provided by the present invention reduces the amount of force required to open the coin chutes during the coin release operation.

The present invention may be embodied in other specific forms without departing from the spirit or essential characteristics thereof. The presently disclosed embodiment is therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. A coin receiving mechanism for use in a coin operated latch unit, comprising:

a unitary frame member having a central wall and two integral mounting plates perpendicular to said wall respectively disposed on two opposite ends of said central wall;

first and second channel members respectively disposed on opposite sides of said central wall and spaced therefrom to define first and second coin chutes, each of said channel members having a slot therein for providing access to said coin chutes;

a pawl support mechanism mounted on one of said mounting plates; and at least one pawl mounted on said support mechanism on each side of said central wall, said pawls being mounted for pivotal movement about axes parallel to said central wall and each having a finger which normally projects into the slot in one of said channel members.

2. The coin receiving mechanism of claim 1 wherein said unitary frame member further includes a pair of integral ribs disposed on each side of said central wall for defining the sides of said coin chutes and for spacing said channel members from said central wall.

3. The coin receiving mechanism of claim 1 wherein said unitary frame member is made from a piece of extruded metal.

4. The coin receiving mechanism of claim 1 or 3 wherein said unitary frame member is made of aluminum.

5. The coin receiving mechanism of claim 1 wherein said unitary frame member is made from plastic.

6. The coin receiving mechanism of claim 1 wherein said channel members are pivotally mounted at one side thereof to said unitary frame member to be pivotable away from said central wall to thereby open said coin chutes to release deposited coins therefrom, and further including means for normally biasing said channels members toward said central wall.

7. The coin receiving mechanism of claim 6 wherein said one mounting plate includes a flange disposed at each end thereof, and said channel members include arms projecting from said one side thereof and attached to said flanges to provide said pivotal mounting.

8. The coin receiving mechanism of claim 7 wherein said arms include meshed teeth, such that pivotal movement of one channel member imparts equal and opposite pivotal movement to the other channel member.

9. The coin receiving mechanism of claim 6, wherein said biasing means includes a tension spring respectively connected at each end to one of said channel members on the side of said channel member opposite said pivotal mounting.

10. The coin receiving mechanism of claim 1 wherein said pawl support mechanism includes an elongated bar having a plurality of apertures for selectively mounting a pawl at a location related to the price of an item.

11. The coin receiving mechanism of claim 10 wherein a pawl is mounted on said bar by means of a pin passing through the pawl and one of said apertures, and wherein said pawl support mechanism further includes a strap interposed between said bar and said one mounting plate, said strap having a raised portion for maintaining said pin in the aperture in said bar when mounted on said one mounting plate.

12. The coin receiving mechanism of claim 1 or 10 further including a manually operable cam mechanism for sliding said pawl support mechanism along said one mounting plate between first and second positions related to the prices of vended items.

13. A coin-operated latch unit, comprising:

a unitary frame member having a central wall and two integral mounting plates respectively disposed on two opposite ends of said central wall;

at least one channel member disposed on one side of said central wall and spaced therefrom to define a coin chute;

a pawl support mechanism mounted on one of said mounting plates;

at least one pawl pivotally mounted on said support mechanism on said one side of said central wall, said pawl having a finger which normally projects into said coin chute;

a latch hook disposed adjacent said frame member; and a pivotable latch member normally engaged by said latch hook, said latch member having a cam surface adapted to engage a coin deposited in said coin chute and biased thereby out of engagement with said latch hook when the deposited coin engages said pawl.

14. The coin operated latch unit of claim 13 wherein said unitary frame member includes a pair of integral ribs disposed on said one side of said central wall to define the sides of said coin chute and space said channel member from said central wall.

15. The coin operated latch unit of claim 13 wherein said unitary frame member is made from a piece of extruded metal.

16. The coin operated latch unit of claim 13 wherein said unitary frame member is made of aluminum.

17. The coin-receiving mechanism of claim 8, wherein said one channel member includes a projection for engagement by a member imparting a force in a direction transverse to said central wall to thereby pivot said channel member.

18. The coin operated latch unit of claim 13 wherein said cam surface normally engages an underside surface of said channel member.

* * * * *